US008496142B2

(12) United States Patent
Uehira et al.

(10) Patent No.: US 8,496,142 B2
(45) Date of Patent: Jul. 30, 2013

(54) FOAM-DISPENSING PUMP CONTAINER

(75) Inventors: Shouji Uehira, Sagamihara (JP); Daisuke Saito, Tokyo (JP)

(73) Assignee: Daiwa Can Company, Chuo-ku, Tokyo (JP)

( * ) Notice: Subject to any disclaimer, the term of this patent is extended or adjusted under 35 U.S.C. 154(b) by 0 days.

(21) Appl. No.: 13/425,510

(22) Filed: Mar. 21, 2012

(65) Prior Publication Data

US 2012/0241477 A1 Sep. 27, 2012

(30) Foreign Application Priority Data

Mar. 22, 2011 (JP) ..... 2011-062181

(51) Int. Cl.
*B67D 7/76* (2010.01)

(52) U.S. Cl.
USPC ..... 222/190

(58) Field of Classification Search
USPC ..... 222/190, 321.1, 321.7, 321.8
See application file for complete search history.

(56) References Cited

U.S. PATENT DOCUMENTS

2002/0056730 A1* 5/2002 van de Heijden ..... 222/190

FOREIGN PATENT DOCUMENTS

JP 2581644 Y2 9/1998

OTHER PUBLICATIONS

Machine Translation of JP 2581644 Y2, published Sep. 24, 1998, Twenty-One Pages.

* cited by examiner

*Primary Examiner* — Paul R Durand
*Assistant Examiner* — Randall Gruby
(74) *Attorney, Agent, or Firm* — Rankin, Hill & Clark LLP

(57) ABSTRACT

The foam-dispensing pump container according to the present invention has the valve seat portion which protrudes inwardly below the air-liquid mixing unit and which is formed of the flexible member that can come into contact with the outer peripheral face of the latch portion of the rod-shaped valve body, and immediately after the nozzle head starts rising, the flexible valve seat portion comes into contact with the rod-shaped valve body before the upper opening end of the liquid chamber comes into contact with the rod-shaped valve body, thereby significantly reducing a backflow of the foam or liquid into the air passage, and consequently improving the usability of the foam-dispensing pump container.

3 Claims, 4 Drawing Sheets

FOAM-DISPENSING PUMP CONTAINER

RELATED APPLICATIONS

This application claims the priority of Japanese Patent Application No. 2011-062181 filed on Mar. 22, 2011, which is incorporated herein by reference.

BACKGROUND OF THE INVENTION

1. Field of the Invention

The present invention relates to foam-dispensing pump containers for discharging, from a foam discharge opening, foam produced by mixing a foamable liquid in the container body and air when a nozzle head is pushed down, and more specifically, to an improvement for preventing usability from being degraded by the liquid or foam flowing backward into the pump after foam is discharged.

2. Description of the Related Art

A variety of configurations have been conventionally proposed for foam-dispensing pump containers that produce foam by mixing a foamable liquid contained in the container body and air drawn into the container from the outside and that discharge the foam from the container to the outside through a foam passage inside a nozzle head, when the nozzle head of a nozzle body provided at the top of the container is pushed down. In those conventional foam-dispensing pump containers, the nozzle head can generally move up and down together with a liquid piston and an air piston.

When the nozzle head moves up, the liquid piston, which is in sliding contact with a liquid cylinder, rises to draw the foamable liquid from the container body into a liquid chamber, and at the same time, the air piston, which is in sliding contact with an air cylinder, rises to draw air into an air chamber from the outside. Then, when the nozzle head moves down, the liquid piston is lowered to bring the foamable liquid into an air-liquid mixing chamber from the liquid chamber, and at the same time, the air piston is lowered to bring air into the air-liquid mixing chamber from the air chamber. The foamable liquid and air brought into the air-liquid chamber are mixed to a foam, and the produced foam is discharged from a foam discharge opening provided at the downstream end of the nozzle head portion.

In those conventional foam-dispensing pump containers, the liquid or foam remaining in the air-liquid mixing chamber sometimes flows backward into an air passage between the air-liquid mixing chamber and the air chamber. The liquid or foam flowing into the air passage dries and solidifies, and narrows or blocks the flow path, causing problems concerning usability of the foam-dispensing pump container, such as lower foam quality caused by a reduction in the amount of air that can be supplied to the air-liquid mixing chamber, or an increased force required to push down the pump.

In view of the problems described above, a foam-dispensing pump container proposed in Japanese Utility Model Registration No. 2581644 can prevent the residual foam or liquid from flowing backward into the air passage from the mixing chamber by providing a rod-shaped valve body having an almost funnel-shaped latch portion in its upper end to close both a liquid chamber outlet on the mixing chamber side and an air passage outlet on the mixing chamber side at the same time. Since foam-dispensing pump containers are generally configured to discharge foam when the nozzle head is lowered, both the liquid chamber outlet on the mixing chamber side and the air passage outlet on the mixing chamber side are left open while the nozzle head is at the bottom dead center. In the foam-dispensing pump container proposed in Japanese Utility Model Registration No. 2581644, after the nozzle head starts rising from the bottom dead center, the rod-shaped valve body closes the air passage outlet on the mixing chamber side and the liquid chamber outlet on the mixing chamber side simultaneously. When the nozzle head starts rising again from the bottom dead center, the liquid chamber and the air chamber increase in volume and are consequently depressurized temporarily. Therefore, in the foam-dispensing pump container proposed in Japanese Utility Model Registration No. 2581644, the residual liquid or air may flow backward into the depressurized air passage or air chamber from the mixing chamber from when the nozzle head starts going up until the rod-shaped valve body closes the liquid chamber outlet on the mixing chamber side and the air passage outlet on the mixing chamber side.

SUMMARY OF THE INVENTION

The present invention is provided in view of the above-described problems in the conventional technologies, and it is an object of the present invention to provide a foam-dispensing pump container that is free from usability problems caused by a backflow of the liquid or air into the pump after foam is discharged.

As a result of intensive study of the problems in the conventional technologies, the inventors have invented a foam-dispensing pump container having a rod-shaped valve body with a latch portion in its upper end for controlling the connection between the air-liquid mixing unit and the liquid chamber. In the lower part of the air-liquid mixing unit, a valve seat portion formed of a flexible member that can come into contact with the outer peripheral face of the latch portion of the rod-shaped valve body is provided in an inwardly projecting manner, and the flexible valve seat portion comes into contact with the rod-shaped valve body before the upper opening end of the liquid chamber comes into contact with the rod-shaped valve body immediately after the nozzle head starts rising. This configuration greatly reduces the backflow of the liquid or air into the air passage and solves the usability problems of the conventional foam-dispensing pump containers.

A foam-dispensing pump container according to the present invention including a container body and a dispensing pump body attached to an opening of the container body, the foam-dispensing pump container producing foam by mixing air and a foamable liquid contained in the container body in an air-liquid mixing unit and discharging the foam from a foam discharge opening disposed in a nozzle head portion provided in the upper part of the dispensing pump body when the nozzle head portion is moved up and down;

the dispensing pump body including:

a tubular liquid cylinder which can be connected to the inside of the container;

a liquid suction valve body which can come into contact with a valve seat portion provided on the inner side of the liquid cylinder and which can consequently open and close the connecting portion between the liquid cylinder and the container;

a tubular liquid piston which can move upward and downward in sliding contact with the inner wall face of the liquid cylinder, makes a liquid chamber at the gap with respect to the liquid cylinder, draws the foamable liquid into the liquid chamber from the container body when moved upward, and pumps the foamable liquid from the liquid chamber through an opening end provided in the upper part to the air-liquid mixing unit thereabove when moved downward;

a closed bottom tubular air cylinder which has a greater diameter than the liquid cylinder and surrounds the outside of the liquid cylinder almost concentrically;

a tubular air piston which can move upward and downward in sliding contact with the inner wall face of the air cylinder, makes an air chamber at the gap with respect to the air cylinder, draws air through an air intake provided to be able to be connected to an upper external space, from the space into the air chamber when moved upward, and pumps air upward through an air vent provided above from the air chamber when moved downward;

an air intake valve body which can open and close the air intake;

an air vent valve body which can open and close the air vent;

an air passage which is connected to the air chamber through the air vent and guides air to the air-liquid mixing unit thereabove;

the air-liquid mixing unit, which is tubular and is connected through an upper opening end of the liquid piston to the inside of the liquid chamber and through the air passage to the inside of the air chamber and produces foam by mixing the foamable liquid drawn from the liquid chamber and air drawn from the air chamber;

a spring which is inserted between the liquid cylinder and the liquid piston to exert force in such a direction that the gap between the liquid cylinder and the liquid piston is expanded;

a rod-shaped valve body which is disposed in a space formed by the liquid cylinder and the liquid piston, has an upper end penetrating the upper opening end of the liquid piston, has an almost funnel-shaped latch portion at its penetrating upper end, the outer diameter of the latch portion being greater than the diameter of the upper opening end of the liquid piston, the outer peripheral face of the latch portion being able to come into contact with the inner peripheral face of the upper opening end of the liquid piston, and the valve body thereby being able to open and close the connecting portion between the liquid piston and the air-liquid mixing unit;

a flexible valve seat portion which includes a plate-like member having flexibility at least in a downward direction, the member being provided below the air-liquid mixing unit, protruding circumferentially inwardly in the air-liquid mixing unit, being able to come into contact with the outer peripheral face of the latch portion of the rod-shaped valve body, and thereby being able to open and close the connecting portions between the air-liquid mixing unit and the liquid chamber and between the air-liquid mixing unit and the air passage, the valve seat portion being able to come into contact with the outer peripheral face of the latch portion of the rod-shaped valve body whereas the outer peripheral face of the latch portion of the rod-shaped valve body is not in contact with the inner peripheral face of the upper opening end of the liquid piston; and a nozzle head which is connected to the air-liquid mixing unit, can move up and down together with the liquid piston and the air piston, and discharges foam produced in the air-liquid mixing unit from a foam discharge opening provided in the opposite end when moved downward.

In the foam-dispensing pump container, the valve seat portion provided in the liquid cylinder and the liquid suction valve body constitute a first valve, the two not coming into contact with each other to open the connecting portion between the liquid cylinder and the container body when the nozzle head moves up, and coming into contact with each other to close the connecting portion between the liquid cylinder and the container body when the nozzle head moves down;

the air intake provided in the air piston and the air intake valve body constitute a second valve, the air intake valve body not coming into contact with the air intake to open the connecting portion between the air chamber and the external space above the air piston when the nozzle head moves up, and the two coming into contact with each other to close the connecting portion between the air chamber and the external space above the air piston when the nozzle head moves down;

the air vent provided in the liquid piston and the air vent valve body constitute a third valve, the air vent valve body coming into contact with the air vent to close the connecting portion between the air chamber and the air passage when the nozzle head moves up, and the two not coming into contact with each other to open the connecting portion between the air chamber and the air passage when the nozzle head portion moves down;

the inner peripheral face of the upper opening end of the liquid piston and the outer peripheral face of the latch portion of the rod-shaped valve body constitute a fourth valve, the two coming into contact with each other to close the connecting portion between the liquid chamber and the air-liquid mixing unit when the nozzle head moves up, and the two not coming into contact with each other to open the connecting portion between the liquid chamber and the air-liquid mixing unit when the nozzle head portion moves down;

the flexible valve seat portion provided in the air-liquid mixing unit and the outer peripheral face of the latch portion of the rod-shaped valve body constitute a fifth valve, the two coming into contact with each other to close the connecting portions between the liquid chamber and the air-liquid mixing unit and between the air passage and the air-liquid mixing unit when the nozzle head moves up, and the two not coming into contact with each other to open the connecting portions between the liquid chamber and the air-liquid mixing unit and between the air passage and the air-liquid mixing unit when the nozzle head moves down; and when the nozzle head moves up from the bottom dead center, the flexible valve seat portion in the fifth valve comes into contact with the outer peripheral face of the latch portion of the rod-shaped valve body before the upper opening end of the liquid piston portion in the fourth valve comes into contact with the outer peripheral face of the latch portion of the rod-shaped valve body, thereby closing the fifth valve and opening the fourth valve temporarily.

The foam-dispensing pump container according to the present invention has the valve seat portion which protrudes inwardly below the air-liquid mixing unit and which is formed of the flexible member that can come into contact with the outer peripheral face of the latch portion of the rod-shaped valve body, and immediately after the nozzle head starts rising, the flexible valve seat portion comes into contact with the rod-shaped valve body before the upper opening end of the liquid chamber comes into contact with the rod-shaped valve body, thereby significantly reducing a backflow of the foam or liquid into the air passage, and consequently improving the usability of the foam-dispensing pump container.

BRIEF DESCRIPTION OF THE DRAWINGS

FIGS. 3(A), 3(B), and 3(C) illustrate the function of the flexible valve seat portion when the nozzle head of the dispensing pump body according to the embodiment of the present invention moves, wherein FIG. 3(A) shows the nozzle head at its lowest position; FIG. 3(B) shows the nozzle head immediately after it starts rising; and FIG. 3(C) shows the rising nozzle head or the nozzle head at its highest position.

DESCRIPTION OF THE PREFERRED EMBODIMENTS

A preferred embodiment of the present invention will be described below with reference to the drawings.

Configuration of the Foam-Dispensing Pump Container

A foam-dispensing pump container in this embodiment includes a container body containing a liquid, a dispensing pump body detachably mounted in an opening in the upper end of the container body, and a tubular body connected to the dispensing pump body and extending into the container body.

Figure 1:
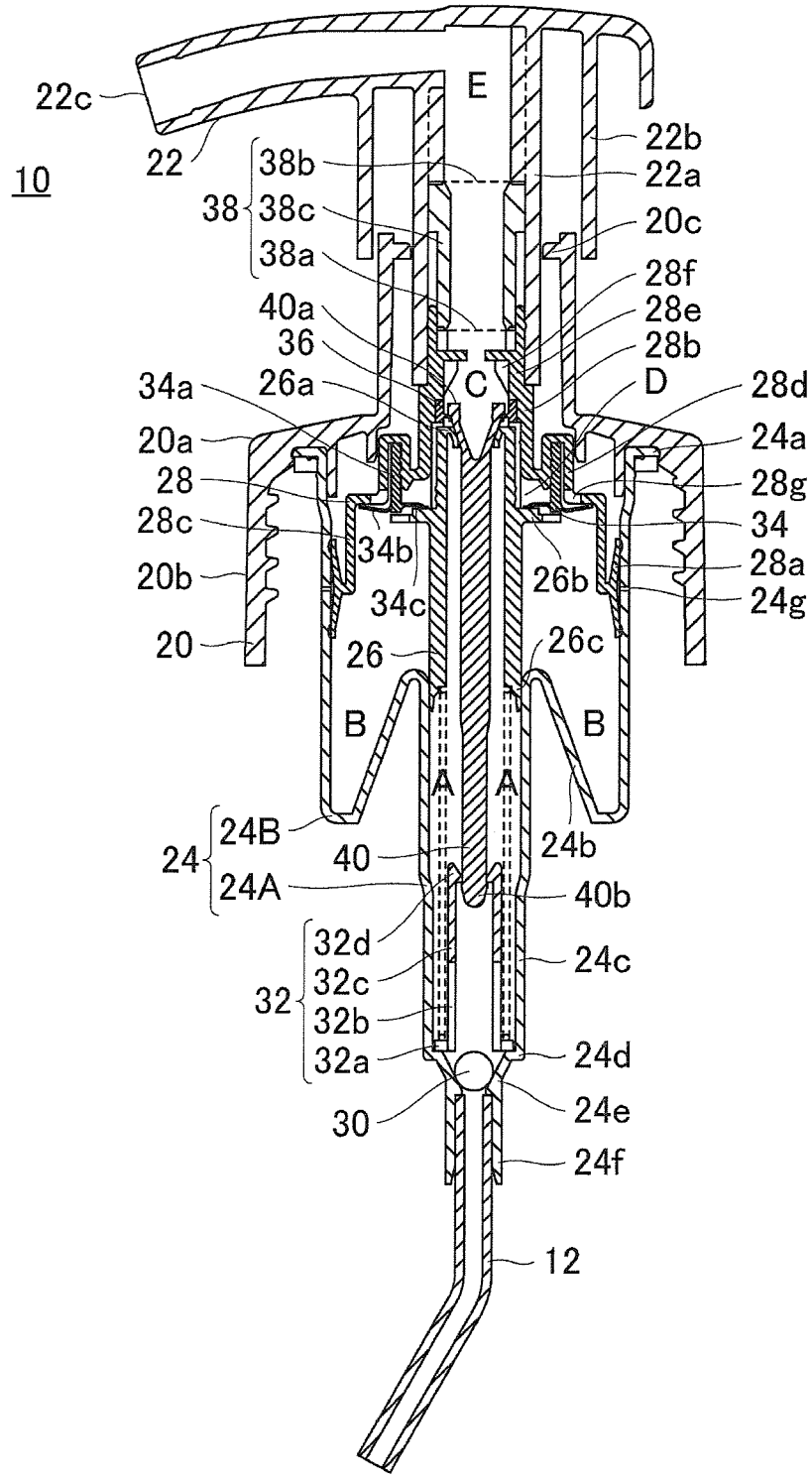
FIG. 1 is a cross-sectional view of a dispensing pump body of a foam dispensing container according to an embodiment of the present invention (a front sectional view showing a state in which the nozzle head is at its highest position).

FIG. 1 shows a front sectional view of the dispensing pump body 10 of the dispensing container according to the embodiment of the present invention, when a nozzle head is in its highest position.

A skirt base cap portion 20 disposed in the lower part of the dispensing pump body 10 in this embodiment has a female thread formed in its inner peripheral face. The opening of the container body (not shown) containing the foamable liquid has a male thread formed in its outer peripheral face. The dispensing pump body 10 is detachably attached to the container body by screwing the base cap portion 20 into the opening of the container body.

The dispensing pump body 10 in this embodiment mainly includes the base cap portion 20, a nozzle head portion 22 which functions as an operating part and a discharge portion, a double-walled cylinder 24 which forms a liquid cylinder 24A and an air cylinder 24B, a liquid piston 26, and an air piston 28. These components are usually formed of synthetic-resin materials. Polyolefin resins such as polypropylene (PP), high-density polyethylene (HDPE), medium-density polyethylene (MDPE), and low-density polyethylene (LDPE), and polyester resins such as polyethylene terephthalate (PET) can be used alone or in an appropriate mixture.

The specific structures of the components of the dispensing pump body 10 will be described next.

The double-walled cylinder 24 is a single integral component formed from a synthetic resin by injection molding or the like. The air cylinder 24B, which has a large diameter, and the liquid cylinder 24A, which has a small diameter, are integrally formed and disposed concentrically. On the edge of the opening at the upper end of the air cylinder 24B, a ring-shaped flange portion 24*a* to be disposed on the upper end of the opening of the container body is formed.

In the air cylinder 24B of the double-walled cylinder 24, the flange portion 24*a* is connected to a tubular portion having a short large-diameter part with an outer diameter equivalent to or a slightly smaller than the inner diameter of the opening of the container body, and a cylinder wall having a slightly smaller uniform inner diameter. From the bottom end of the cylinder wall of the air cylinder 24B, a coupling portion 24*b* extends upward and radially inwardly.

The upper end of the liquid cylinder 24A of the double-walled cylinder 24 is connected to the radially inward edge of the coupling portion 24*b* and extends downward from the coupling portion 24*b*. On the lower edge of a tubular cylinder wall 24*c*, a ring-shaped seat portion 24*d* is formed to function as a portion where the lower end of a tubular latch body 32, which will be described later, rests. Below that, a funnel-shaped ball valve seat portion 24*e*, which functions as a valve seat of a ball valve 30, is formed. Formed further below that is a lower tubular portion 24*f*, in which a tubular body 12 for guiding the foamable liquid from the container body into the liquid cylinder 24A is press-inserted. The tubular body 12 press-inserted into the lower tubular portion 24*f* extends to around the bottom of the container body.

The air piston 28 and the liquid piston 26 are formed independently of each other from a synthetic resin by injection molding or the like. They are then connected concentrically and become a single piston body. In the double-walled cylinder 24, a sliding seal portion 28*a* of the air piston 28 is disposed to slide along the inner face of the cylinder wall of the air cylinder 24B; and a sliding seal portion 26*c* of the liquid piston 26 is disposed to slide along the inner face of the cylinder wall 24*c* of the liquid cylinder 24A. The nozzle head portion 22 is connected to the upper end of the air piston 28.

The air piston 28 has an upper small-diameter portion 28*b* in a center portion and a lower large-diameter portion 28*c* disposed concentrically with respect to the upper small-diameter portion 28*b*, the two being integrally formed through a middle coupling portion 28*d*. The middle coupling portion 28*d* is formed radially inwardly from the upper edge of the lower large-diameter portion 28*c*, and the upper small-diameter portion 28*b* is raised from the inner peripheral edge portion of the middle coupling portion 28*d*. A reduced-diameter portion 28*e*, which has a slightly reduced inner diameter, is disposed on the upper edge portion of the upper small-diameter portion 28*b*, and the upper small-diameter portion 28*b* and the reduced-diameter portion 28*e* form a step portion. A flexible valve seat portion 36, which will be described later, is inserted in and positioned in contact with the step portion. Vertical ribs 28*f* are radially disposed on the inner face of the reduced-diameter portion 28*e*. The vertical ribs 28*f* are formed as an inclined face having a lower face inclined toward the lower outer direction. The sliding seal portion 28*a* is integrally formed on the lower edge of the lower large-diameter portion 28*c* in such a manner that it can slide up and down on the inner face of the air cylinder 24B and can also ensure sufficient air tightness with respect to the inner face of the cylinder wall of the air cylinder 24B.

The entire shape of the liquid piston 26 is almost cylindrical, and a funnel-shaped liquid chamber valve seat portion 26*a* whose inner diameter increases as it goes upward is formed on the inner face side of the top end portion of the center hollow portion. A sliding seal portion 26*c* is formed in the lower end portion of the liquid piston 26 and slides up and down on the inner face of the cylinder wall 24*c* of the liquid cylinder 24A in the liquid-tight state. A ring-shaped flat portion is formed inside the sliding seal portion 26*c* to function as a portion where the upper end of a coil spring, which will be described later, rests.

The air piston 28 and the liquid piston 26 are integrally connected to form a single piston body by inserting the upper end portion of the liquid piston 26 into the lower inner side of the upper small-diameter portion 28*b* of the air piston 28. The integrated pistons 26 and 28 can integrally move up and down by inserting the air piston 28 into the air cylinder 24B and inserting the liquid piston 26 into the liquid cylinder 24A, in the double-walled cylinder 24.

A coil spring (shown by a broken line in FIG. 1) is inserted between the liquid piston 26 and the liquid cylinder 24A. The coil spring is inserted between the lower end of the liquid cylinder 24A and the lower end of the liquid piston 26 via a ring-shaped rest 32*a* formed on the lower edge of the tubular latch body 32, which will be described later. With the force exerted by the coil spring, the pistons 26 and 28 are always pushed up with respect to the double-walled cylinder 24.

In the container configured as described above, a liquid chamber A is formed as a space enclosed by the liquid cylinder 24A and the liquid piston 26, and an air chamber B is formed as a space enclosed by the air cylinder 24B, the air piston 28, and the liquid piston 26. The flexible valve seat portion 36, which will be described later, is fit into the space between the upper end of the liquid piston 26 and the inner face of the step portion formed in the upper part of the upper small-diameter portion 28*b* of the air piston 28, and a mixing chamber C is formed as a space enclosed by the reduced-diameter portion 28*e* of the air piston 28, the flexible valve seat portion 36, a latch portion 40*a* in the end of a rod-shaped valve body 40, which will be described later, and a porous material holder 38. An air passage D for sending air from the air chamber B to the mixing chamber C is formed as a space enclosed by the outer side above the liquid piston 26, the inner side of the upper small-diameter portion 28*b* of the air piston 28, and the bottom face of the flexible valve seat portion 36.

The flexible valve seat portion 36 is fit into the inside of the step portion near the upper edge of the upper small-diameter portion 28*b* of the air piston 28, and the lower inner portion of the upper small-diameter portion 28*b* is the fit portion where the liquid piston 26 is fit. A plurality of vertical grooves are provided in a circumferential direction at a location corresponding to the fit portion in the upper outer face of the liquid piston 26. These grooves form the air passage D between the upper outer face of the liquid piston 26 and the inner face of the air piston 28.

At a location corresponding to the fit portion in the upper outer face of the liquid piston 26, vertical ribs are provided to form the vertical grooves. The outer diameter of an imaginary circle connecting the outer surface of the vertical ribs is almost equal to the inner diameter of the upper small-diameter portion 28*b* of the air piston 28 so that the vertical ribs can be pressed into the upper small-diameter portion 28*b* of the air piston 28. The vertical grooves or vertical ribs for forming the air passage D may be provided on the inner face side of the air piston 28 instead of the location corresponding to the fit portion in the upper outer surface of the liquid piston 26.

Flexible Valve Seat Portion

Figure 2:
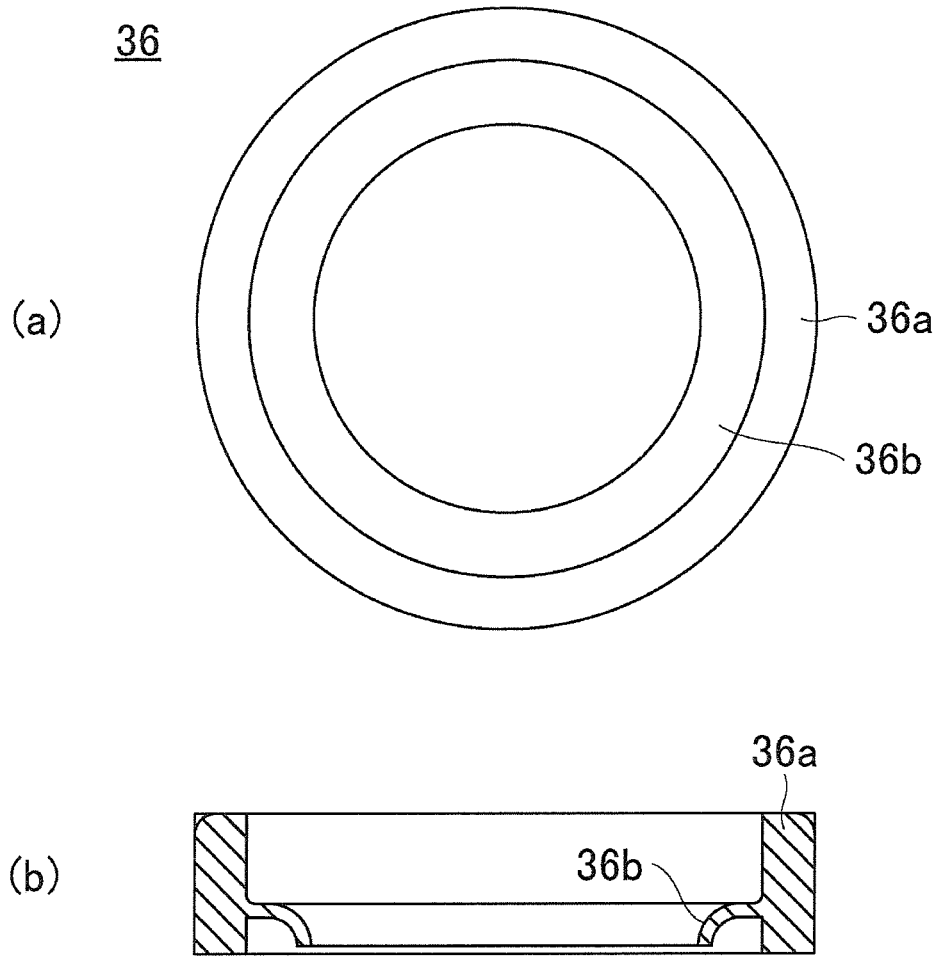
FIGS. 2(*a*) and 2(*b*) respectively show a plan view and a front sectional view of a flexible valve seat portion according to the embodiment of the present invention.

FIGS. 2(*a*) and 2(*b*) respectively show a plan view and a vertical sectional view of the flexible valve seat portion 36 of the embodiment of the present invention.

The flexible valve seat portion 36 is an almost tubular component that includes an outer peripheral portion 36*a* and a flexible valve seat part 36*b* which has a relatively small thickness and projects from the outer peripheral portion 36*a* toward the inside to surround the opening in the center. The flexible valve seat part 36*b* is formed of a flexible material such as a synthetic resin and is provided to have flexibility at least in the downward direction.

The outer diameter of the outer peripheral portion 36*a* of the flexible valve seat part 36 is made almost equal to the inner diameter of the upper small-diameter portion 28*b* of the air piston, and the inner diameter of the outer peripheral portion 36*a* is made almost equal to the inner diameter of the reduced-diameter portion 28*e* of the air piston. The inner diameter of the flexible valve seat part 36*b* of the flexible valve seat part 36 is made smaller than the maximum outer diameter of the tip of the latch portion 40*a*, which has an almost funnel shape, so that the latch portion 40*a* provided in the tip end of the rod-shaped valve body 40 can come into contact therewith.

The outer peripheral portion 36*a* of the flexible valve seat portion 36 is fit into the upper part of the upper small-diameter portion 28*b* of the air piston 28 and is positioned in contact with the step portion formed between the upper small-diameter portion 28*b* and the reduced-diameter portion 28*e*. The lower face of the flexible valve seat portion 36 is positioned above the top face of the liquid piston 26, and the space between the lower face of the flexible valve seat portion 36 and the top face of the liquid piston 26 form the air passage D horizontally connected to the mixing chamber C. The vicinity of the edge portion of the valve seat part 36*b* of the flexible valve seat portion 36 becomes an outlet of the air passage D, which is an opening linked to the mixing chamber C.

The edge of the valve seat part 36*b* of the flexible valve seat portion 36 can close the connections between the mixing chamber C and the liquid chamber A and between the mixing chamber C and the air passage D when it is in contact with the almost funnel-shaped latch portion 40*a* provided in the end of the rod-shaped valve body 40. When the funnel-shaped liquid chamber valve seat portion 26*a* provided at the upper end portion of the liquid piston 26 comes into contact with the latch portion 40*a* of the rod-shaped valve body 40, the connection between the mixing chamber C and the liquid chamber A can be closed, which will be described later. In the dispensing pump body 10 of this embodiment, the latch portion 40*a* of the rod-shaped valve body can come into contact with the valve seat part 36*b* of the flexible valve seat portion whereas it is not in contact with the liquid chamber valve seat portion 26*a*.

Since the flexible valve seat part 36*b* projects to a position closer to the latch portion 40*a* of the rod-shaped valve body than the funnel-shaped liquid chamber valve seat portion 26*a*, the flexible valve seat part 36*b* and the latch portion 40*a* come into contact with each other before the liquid chamber valve seat portion 26*a* and the latch portion 40*a* come into contact with each other. The flexible valve seat part 36*b* has flexibility at least in the downward direction and is bent downward when it comes into contact with the latch portion 40*a* of the rod-shaped valve body and is pressed down further by the latch portion 40*a*, so that the latch portion 40*a* can also come into contact with the liquid chamber valve seat portion 26*a*. The specific function of the flexible valve seat part 36*b* when the dispensing pump body 10 of this embodiment is used will be described later.

The other components of the dispensing pump body 10 in this embodiment will be described below.

The nozzle head portion 22 connected to the air piston 28 has a double side wall including an inner tubular portion 22*a* and an outer tubular portion 22*b*, and a foam passage E is formed as an L-shaped through-hole which has an upper bent portion and goes through the inner tubular portion 22*a*. After the base cap portion 20 is set on the head of the double-walled cylinder 24 incorporating the air piston 28 and the liquid piston 26, when the upper edge of the reduced-diameter portion 28*e* of the air piston 28 is inserted into and secured to the lower edge portion of the inner tubular portion 22*a* of the nozzle head portion 22, the nozzle head portion 22 is integrally connected with the air piston 28 and the liquid piston 26, and the mixing chamber C formed in the upper inner side of the reduced-diameter portion 28*e* of the air piston 28 is connected to the foam passage E in the nozzle head portion 22.

In the foam passage E in the nozzle head portion 22, the porous material holder 38 holding porous sheets 38*a* and 38*b* in a tensioned state at its both ends is inserted on the downstream side of the mixing chamber C before the air piston 28 is connected. The porous material holder 38 may have a net woven from synthetic resin thread as the porous sheets 38*a* and 38*b* and may attach them by melting both ends of a tubular synthetic-resin spacer 38*c*. It is preferable in terms of foam quality that the downstream porous sheet 38*b* (closer to a foam discharge opening 22*c*) has smaller meshes than the upstream porous sheet 38*a* (closer to the mixing chamber C).

The base cap portion 20 for clamping the dispensing pump body 10 to the opening of the container body includes a top wall portion 20*a* having an opening at its center, a skirt portion 20*b* suspended from the outer peripheral edge portion of the top wall portion 20*a*, and an upright wall 20*c* standing erect from an opening edge portion of the top wall portion 20*a*. From the lower face of the top wall portion 20*a*, a ring-like tubular portion to be in contact with the inner face of the flange portion 24*a* of the air cylinder 24B and another ring-like tubular portion having a smaller diameter are suspended. The skirt portion 20*b* of the base cap portion 20 has a female thread on its inner peripheral wall and covers the opening of the container body when screwed to the container body opening, which has a male thread formed on the outer peripheral face.

In the dispensing pump body 10 of this embodiment, a ball valve 30 is placed on the funnel-shaped ball valve seat portion 24*e* near the lower end of the liquid cylinder 24A, and they form a first valve. When the liquid chamber A is at normal or increased pressure, the ball valve 30 comes into contact with the ball valve seat portion 24*e* and closes the lower opening of the liquid cylinder 24A. When the liquid chamber A is at negative pressure, the ball valve 30 is separated from the ball valve seat portion 24*e* and opens the lower opening of the liquid cylinder 24A.

An elastic valve body 34 made of a soft synthetic resin is disposed between the lower face of the outer periphery of the middle coupling portion 28*d* of the air piston 28 and the upper face of a ring-like convex portion 26*b* formed on the outer peripheral face of the liquid piston 26. The elastic valve body 34 acts on an air intake 28*g* formed in the middle coupling portion 28*d* of the air piston 28 and the inlet side (on the side of the air chamber B) of the air passage D formed in the insertion joint of the air piston 28 and the liquid piston 26. When the air chamber B is at negative pressure, the air intake 28*g* is connected (second valve), and when the air chamber B is pressurized, the air chamber B and the air passage D are connected (third valve).

The elastic valve body 34 includes a tubular base portion 34*a*, a thin ring-shaped outer valve portion 34*b*, and a thin ring-shaped inner valve portion 34*c*, which are integrally formed, the outer valve portion extending externally from the vicinity of the lower edge of the tubular base portion 34*a* and the inner valve portion extending internally from the vicinity of the lower edge of the tubular base portion 34*a*. The tubular base portion 34*a* of the elastic valve body 34 is secured by the middle coupling portion 28*d* of the air piston 28; and is disposed above the air chamber B in such a manner that the outer edge portion of the top face of the outer valve portion 34*b* comes into contact with the lower face (on the side of the air chamber B) of the middle coupling portion 28*d* at a position radially outer of the air intake 28*g*, and the inner edge portion of the lower face of the inner valve portion 34*c* comes into contact with the top face of the ring-like convex portion 26*b* formed in the liquid piston 26. There is sufficient space for the inner valve portion 34*c* of the elastic valve body 34 to bend upward below the lower face of the middle coupling portion 28*d*.

In the second valve for opening and closing the air intake 28*g*, when the air chamber B is at normal or increased pressure, the outer edge portion of the outer valve portion 34*b* comes into contact with the lower face of the middle coupling portion 28*d* to close the air intake 28*g*, which is the connection channel between the air chamber B and the outside air. When the air piston 28 rises in this state, the air chamber B is at negative pressure, causing the outer valve portion 34*b* of the elastic valve body 34 to deform downward (elastic deformation) to be separated from the lower face of the middle coupling portion 28*d*, consequently opening the air intake 28*g*.

In the third valve which controls the connection between the air chamber B and the air passage D, when the air chamber B is at normal or negative pressure, the inner edge portion of the inner valve portion 34*c* comes into contact with the ring-like convex portion 26*b* of the liquid piston 26 to close the inlet portion from the air chamber B to the air passage D. When the air piston 28 is lowered, the air chamber B is pressurized, causing the inner valve portion 34*c* of the elastic valve body 34 to deform upward (elastic deformation) to be separated from the ring-like convex portion 26*b*, consequently opening the inlet of the air passage D. Since the elastic valve body 34 closes the inlet of the air passage D from the air chamber B when the air chamber B is at negative or normal pressure, when the nozzle head portion 22 is in a high position together with the air piston 28, the inlet of the air passage D from the air chamber B is closed. Since the volume of the air passage D does not change even if the nozzle head portion 22 rises, while the nozzle head is up, the air passage D is maintained at normal pressure.

The nozzle head portion 22 secured to the liquid piston 26 and the air piston 28 from above has an outer tubular portion 22*b* with an empty space through which air can pass and is guided by the end of the upright wall 20*c* of the base cap portion 20. The air cylinder 24B has an air hole 24*g* in the upper part of the cylinder wall to let the outside air enter the head space (space above the level of the foamable liquid) of the container body through the space between the inner edge of the upright wall 20*c* of the base cap portion 20 and the outer peripheral face of the outer tubular portion 22*b* of the nozzle head portion 22. The sliding seal portion 28*a* of the air piston 28 has a shallow U-shape in cross-section so that it closes the air hole 24*g* by covering it from the inside when the air piston 28 is in its highest position. As the air piston 28 moves downward, the air hole 24*g* is separated from the sliding seal portion 28*a*, and the outside air communicates with the container body.

In the dispensing pump body 10 in this embodiment, the space formed by the liquid piston 26 and the liquid cylinder 24A contains the synthetic-resin rod-shaped valve body 40. The synthetic-resin tubular latch body 32 for restricting the rise of the rod-shaped valve body 40 is disposed at a lower part of the liquid cylinder 24A. When the nozzle head portion 22 moves down, the latch portion 40*a* disposed at the end of the rod-shaped valve body 40 and the funnel-shaped liquid chamber valve seat portion 26*a* disposed at the upper end of the liquid piston 26 open the upper outlet of the liquid chamber A (liquid piston 26) (fourth valve).

On the outer peripheral face of the rod-shaped valve body 40 near its upper end, a funnel-shaped latch portion 40*a* having a greater diameter is formed; at least the largest diameter of the latch portion 40*a* is greater than the smallest inner diameter of the liquid chamber valve seat portion 26*a* formed on the inner periphery face of the liquid piston 26 near its end. The latch portion 40*a* of the rod-shaped valve body 40 and the liquid chamber valve seat portion 26*a* of the liquid piston 26 constitute the fourth valve. Since the latch portion 40*a* and the liquid chamber valve seat portion 26*a* are not in contact with each other when the nozzle head portion 22 is in the bottom dead center, the upper-end outlet of the liquid piston 26 is open. As the nozzle head portion 22 rises, the liquid piston valve seat portion 26*a* rises. When it comes into contact with the latch portion 40*a*, the upper-end outlet of the liquid piston 26 is closed. Until the upper-end outlet of the liquid piston 26 is closed, the rise of the liquid piston 26 gradually increases the volume of the liquid chamber A, so that the liquid chamber A is temporarily depressurized.

In the small-diameter lower end of the rod-shaped valve body 40, a flange 40*b* is formed to form a step with the upper part and provide a tapered lower end. The flange 40*b* can be held to move up and down in a predetermined range by a tubular latch body 32. Therefore, the rod-shaped valve body 40 is held to move up and down with respect to the liquid cylinder 24A just in a predetermined range, and the highest positions of the liquid piston 26 and the air piston 28 are limited by the rod-shaped valve body 40. It is preferable that the small-diameter lower end of the rod-shaped valve body 40 be configured to generate a small frictional resistance that does not disturb its movement when it moves up and down while being held by the tubular latch body 32. With that configuration, when the liquid chamber valve seat portion 26*a* raised by the rise of the nozzle head portion 22 comes into contact with the latch portion 40*a*, the latch portion 40*a* is pressed against the liquid chamber valve seat portion 26*a* by the frictional resistance. The latch portion 40*a* in contact with the valve seat portion 26*a* will not rise, and superior sealing can be provided.

The tubular latch body 32 is supported upright by the lower base 24*d* of the double-walled cylinder 24, and a ring-shaped rest 32*a* is formed on its lower edge. Formed above the ring-shaped rest 32*a* is a tubular opening portion 32*b* with a plurality of vertical open grooves (or split grooves) formed radially to act as liquid passages. Formed above the tubular opening portion 32*b* is a completely cylindrical portion 32*c* (without a hole). On the upper edge of the cylindrical portion 32*c*, a ring-like inward projection 32*d* is formed. The ring-shaped rest 32*a* in the lower edge functions as a portion on which the lower end of the coil spring rests.

The ring-like inward projection 32*d* formed on the upper edge of the tubular latch body 32 stops the flange 40*b* in the lower end of the rod-shaped valve body 40 and blocks the rise of the rod-shaped valve body 40. The ring-like inward projection 32*d* works together with the latch portion 40*a* of the rod-shaped valve body 40 in contact with the liquid chamber valve seat portion 26*a* of the liquid piston 26 to restrict the highest position of the liquid piston 26 and the air piston 28 pushed up by the coil spring. The lower edge of the tubular latch body 32 restricts the rising distance of the ball valve 30 in the first valve.

Function of the Flexible Valve Seat Portion

Figure 3:
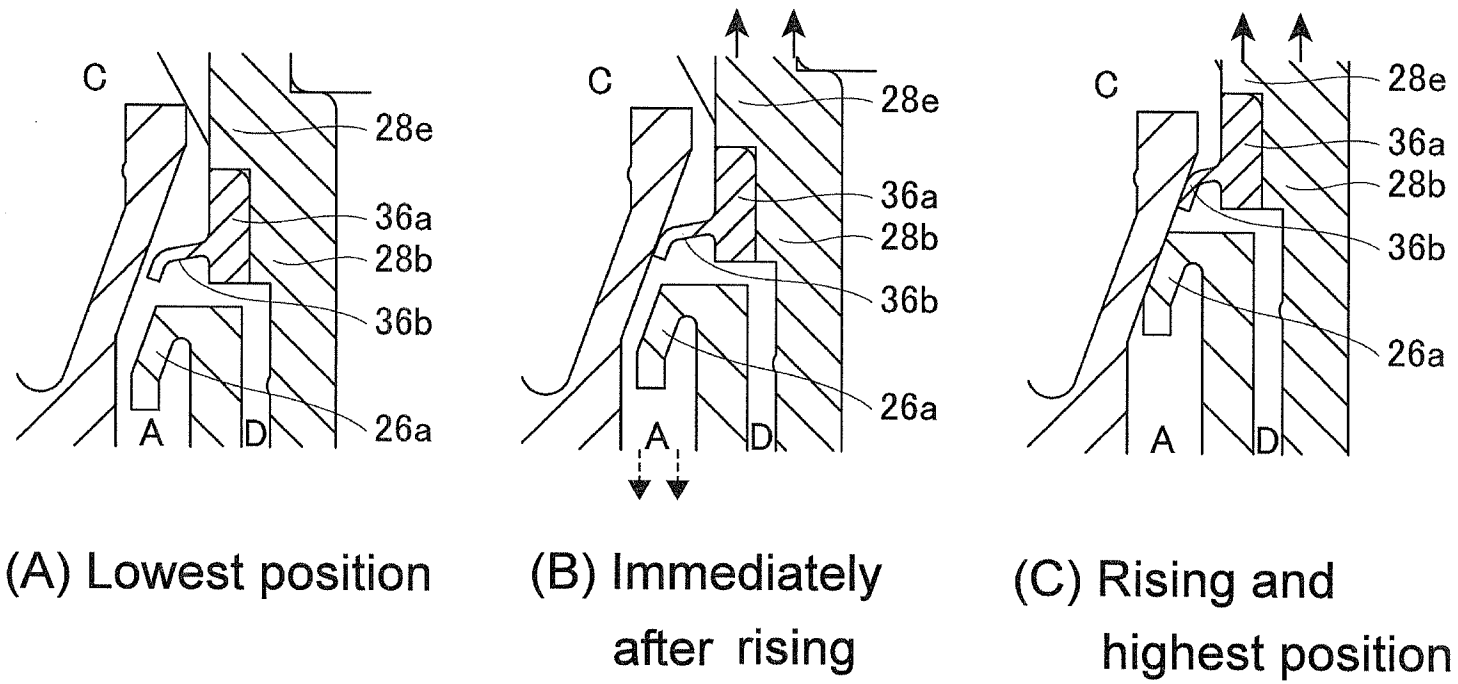

FIGS. 3(A) to 3(C) show enlarged cross-sectional views of the periphery of the flexible valve seat portion 36 in the dispensing pump body 10 of this embodiment, and the function of the flexible valve seat portion will be described next. FIGS. 3(A) to 3(C) are expanded sectional views of a main portion, respectively showing a state when the nozzle head is at its lowest position, a state immediately after its upward movement from the lowest position, and a state during its upward movement or when it is at its highest position.

As shown in FIGS. 3(A) to 3(C), the flexible valve seat portion 36 is disposed near the outlet of the air passage D at the mixing chamber C side in the dispensing pump body 10 of this embodiment. The flexible valve seat portion 36 includes the outer peripheral portion 36*a* and the flexible valve seat part 36*b* disposed at a lower internal position. The inner diameter of the flexible valve seat part 36*b* is smaller than the largest outer diameter of the end of the latch portion 40*a* such that it can come into contact with the funnel-shaped latch portion 40*a* disposed at the end of the rod-shaped valve body 40. As shown in FIGS. 3(B) and 3(C), when the flexible valve seat part 36*b* comes into contact with the latch portion 40*a*, the connection between the air passage D or the liquid chamber A and the mixing chamber C is closed (fifth valve).

As shown in FIG. 3(A), when the nozzle head portion 22 is pushed down to its lowest position, the flexible valve seat part 36*b* is not in contact with the latch portion 40*a*, and the air passage D and the mixing chamber C are connected. Since the liquid chamber valve seat portion 26*a* is not in contact with the latch portion 40*a* either, the liquid chamber A and the mixing chamber C are also connected. That is, when the nozzle head portion 22 is in its lowest position, the foamable liquid and air are sent to the mixing chamber C respectively from the liquid chamber A and the air passage D and are mixed to a foam, and the foam is discharged from the foam discharge opening 22*c* through the foam passage E.

In the conventional dispensing pump body, when the nozzle head portion is in its lowest position, the liquid or foam remaining in the mixing chamber may flow back through the inner wall to the air passage D, degrading the usability of the foam-dispensing container. In the dispensing pump body 10 of this embodiment, the flexible valve seat part 36*b* projecting inwardly is disposed above the connecting portion of the mixing chamber C and the air passage D and functions as an overhang with respect to the air passage, making it difficult for the foam or liquid remaining in the mixing chamber C to flow back directly into the air passage D. The flexible valve seat part 36*b* projecting inwardly reduces the possibility that the foam or liquid remaining in the mixing chamber C flows down into the air passage D by gravity or the like.

As shown in FIG. 3(B), immediately after the nozzle head portion 22 starts rising from its lowest position (FIG. 3(A)), the flexible valve seat part 36*b* comes into contact with the latch portion 40*a* before the liquid chamber valve seat portion 26*a* comes into contact with the latch portion 40*a* and leaves open only the connecting portion between the air passage D and the liquid chamber A temporarily. In the state shown in FIG. 3(B), the rise of the nozzle head portion 22 slightly increases the volume of the liquid chamber A and consequently depressurizes the liquid chamber A temporarily. On the contrary, since the rise of the nozzle head portion 22 does not change the volume of the air passage D and the connecting portion with the air chamber B is kept always closed by the third valve when the nozzle head portion 22 rises, the air passage D is at normal pressure. Because just the liquid chamber A is depressurized whereas the air passage D is under normal pressure in the state shown in FIG. 3(B), even if the foam or liquid remains in the mixing chamber C, such as in a space below the flexible valve seat part 36*b*, the foam or liquid is drawn into the liquid chamber A.

In the dispensing pump body 10 of this embodiment, immediately after the nozzle head portion 22 starts rising from its lowest position, the flexible valve seat part 36*b* comes into contact with the latch portion 40*a* before the liquid chamber valve seat portion 26*a* comes into contact with the latch portion 40*a* to depressurize just the liquid chamber A temporarily. As shown in FIG. 3(B), the foam or liquid remaining around the mixing chamber C can be drawn into the liquid chamber A and hardly flows back into the air passage D. Any foam or liquid that has flowed back into the liquid chamber A mixes with the foamable liquid in the liquid chamber A and does not affect the usability of the foam-dispensing container.

When the nozzle head portion 22 rises further, as shown in FIG. 3(C), the flexible valve seat part 36*b* bends downward, bringing the liquid chamber valve seat portion 26*a* into contact with the latch portion 40*a* as well. In that state, all the connecting portions among the liquid chamber A, the mixing chamber C, and the air passage D are closed. The nozzle head portion 22, upon reaching its highest position, also produces the state shown in FIG. 3(C). Although the nozzle head of a usual foam-dispensing pump container is relatively often left in its highest position after it is used, in the dispensing pump body 10 in this embodiment, even when the nozzle head is in its highest position, the connecting portions among the liquid chamber A, the mixing chamber C, and the air passage D are closed, and the liquid or foam will not flow back into the air passage D from the liquid chamber A or the mixing chamber C.

In the dispensing pump body 10 of this embodiment, the valve seat part 36*b* of the flexible valve seat part 36 has a bent edge portion. Since the flexible valve seat part 36*b* securely comes into contact with the funnel-shaped latch portion 40*a* of the rod-shaped valve body 40 at its bent position, stable sealing performance can be obtained. The edge of the flexible valve seat part 36*b* is not necessarily bent and may be almost linear, for example. When the flexible valve seat part 36*b* in contact with the latch portion 40*a* is pushed down further, it bends downward further, producing an upward reaction force. As shown in FIG. 3(C), since the flexible valve seat part 36*b* is pushed against the latch portion 40*a* while the nozzle head is in its highest position, the sealing performance can be improved further.

Operation of Foam-Dispensing Pump Container

The dispensing pump body 10 of this embodiment is configured as roughly described above.

The operation of the dispensing pump body 10 of this embodiment will be described next.

Figure 4:
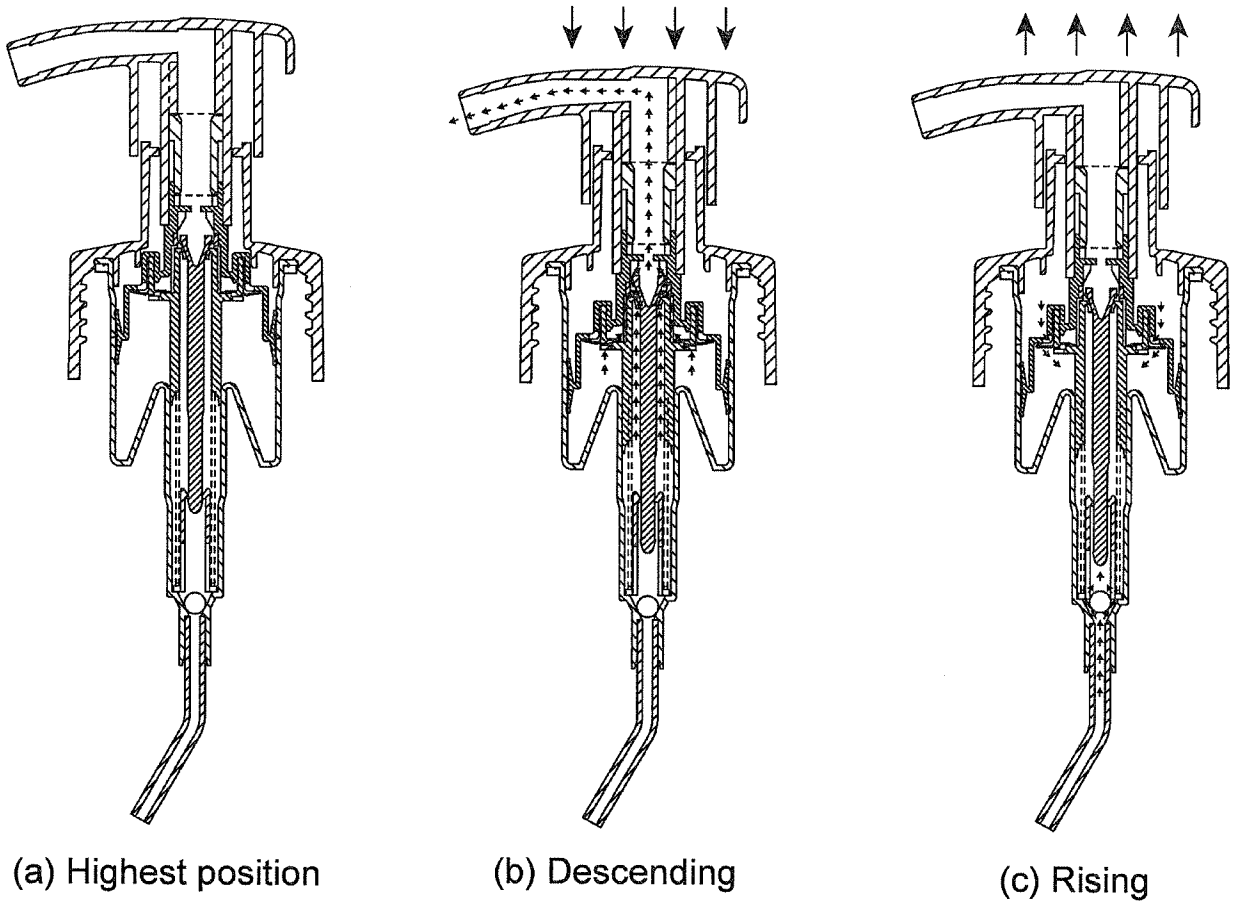
FIGS. 4(*a*), 4(*b*), and 4(*c*) illustrate the operation when the nozzle head of the dispensing pump body of the embodiment of the present invention is at its highest position, is descending, and is rising, respectively.

The foam-dispensing pump container in this embodiment is filled with a liquid when its assembly process is completed. Until the user starts using the container, the force exerted by the coil spring keeps the air piston 28 and the liquid piston 26 in their highest positions, as shown in FIG. 4(*a*). The air hole 24*g* provided in the upper part of the cylinder wall of the air cylinder 24B as means for guiding the outside air into the head space in the container body is closed by the sliding seal portion 28*a* of the air piston 28.

In the first valve, the ball valve 30 comes into contact with the ball valve seat portion 24*e* to block the lower inlet of the liquid chamber A. In the second valve, the outer valve portion 34*b* of the elastic valve body 34 comes into contact with the lower face of the middle coupling portion 28*d* at the periphery rather than the air intake 28*g* to close the air intake 28*g*. In the third valve, the inner valve portion 34*c* of the elastic valve body 34 comes into contact with the upper face of the ring-like convex portion 26*b* of the liquid piston 26 and closes the inlet of the air passage D. In the fourth valve, the latch portion 40*a* at the end of the rod-shaped valve body 40 comes into contact with the funnel-shaped liquid chamber valve seat portion 26*a* and closes the upper outlet of the liquid chamber A. In the fifth valve, the latch portion 40*a* and the flexible valve seat part 36*b* come into contact with each other to close the outlet of the air passage D.

When the user pushes down the nozzle head portion 22 to start using the container in that state, the air piston 28 and the liquid piston 26 start moving down integrally with the nozzle head portion 22, as shown in FIG. 4(*b*). However, the rod-shaped valve body 40 is not lowered until it comes into contact with the vertical ribs 28*f* provided in the inner face of the upper edge portion of the reduced-diameter portion 28*e*. Accordingly, in the fourth valve, when the air piston 28 and the liquid piston 26 start descending together with the nozzle head portion 22, the latch portion 40*a* of the rod-shaped valve body 40 and the liquid chamber valve seat portion 26*a* of the liquid piston 26 are separated to open the upper outlet of the liquid chamber A. In the fifth valve, the flexible valve seat part 36*b* starts descending integrally with the lowered nozzle head portion 22, so that the latch portion 40*a* of the rod-shaped valve body 40 and the flexible valve seat part 36*b* are separated to open the outlet of the air passage D.

In the dispensing pump body 10 of this embodiment, because of the lower face of the vertical ribs 28*f* inclined in a radially outward direction, the latch portion 40*a* of the rod-shaped valve body 40 is always guided toward the center of the liquid piston 26. Since the space formed between the liquid chamber valve seat portion 26*a* and the rod-shaped valve body 40 becomes approximately uniform in the circumferential direction, the foamable liquid pumped from the liquid chamber A to the mixing chamber C flows evenly in the circumferential direction, producing an even mixture of the liquid and air, and consequently a good foam.

In the first valve below the liquid cylinder 24A, the ball valve 30 is held in contact with the ball valve seat portion 24*e*, closing the lower end of the liquid chamber A. The air pressure of the air chamber B pressurized by the lowered air piston 28 presses the elastic valve body 34 toward the middle coupling portion 28*d*. Accordingly, in the second valve, the tubular base portion 34*a* of the elastic valve body 34 is secured to the middle coupling portion 28*d*, and the outer valve portion 34*b* is pressed against the lower face of the middle coupling portion 28*d* by a greater force, keeping the air intake 28*g* closed. In the third valve, the inner valve portion 34*c* bends upward and is separated from the upper face of the ring-like convex portion 26*b* of the liquid piston 26, opening the inlet of the air passage D.

When the user pushes down the nozzle head portion 22 first to start using the container, air is sent from the air chamber B to the mixing chamber C. Air is also sent from the liquid chamber A, which is not yet filled with the liquid, to the mixing chamber C. Therefore, only air is discharged from the foam discharge opening 22*c* through the foam passage E in the nozzle head portion 22.

When the nozzle head portion 22 is released after it is pushed down first, the force exerted by the coil spring pushes up the liquid piston 26, and the air piston 28 immediately rises integrally therewith, as shown in FIG. 4(*c*). Since the liquid chamber valve seat portion 26*a* of the risen liquid piston 26 comes into contact with the latch portion 40*a* of the rod-shaped valve body 40 a little later and exerts an upward force, the rod-shaped valve body 40 also starts rising, and finally the liquid piston 26 and the air piston 28 return to their highest positions, as shown in FIG. 4(*a*). The function of the flexible valve seat part 36*b* when the nozzle head portion 22 rises is as described earlier with reference to FIGS. 3(A) to 3(C).

When the nozzle head portion 22 is released after it is pushed down, the air piston 28 and liquid piston 26 rise integrally, depressurizing the air chamber B, and in the fourth valve, the latch portion 40*a* of the rod-shaped valve body 40 and the liquid chamber valve seat portion 26*a* of the liquid piston 26 come into contact with each other, closing the upper outlet of the air chamber A, and the rod-shaped valve body 40 rising integrally with the liquid piston 26 depressurizes the liquid chamber A as well. Since the liquid chamber A is depressurized, the ball valve 30 in the first valve is separated from the ball valve seat portion 24*e*, opening the lower inlet of the liquid chamber A. In the second valve and the third valve, the outer valve portion 34*b* of the elastic valve body 34 bends downward and is separated from the lower face of the middle coupling portion 28*d*, and the inner valve portion 34*c* returns downward and comes into contact with the upper face of the ring-like convex portion 26*b* of the liquid piston 26. This opens the air intake 28*g* and closes the inlet of the air passage D.

As a result, the foamable liquid in the container body is drawn into the depressurized liquid chamber A through the tubular body 12, and the outside air entering from the gap between the outer peripheral face of the inner tubular portion 22*a* of the nozzle head portion 22 and the inner peripheral face of the upright wall 20*c* of the base cap portion 20 is drawn into the air chamber B through the air intake 28*g*. The container is thus ready for producing foam. The foamable liquid drawn into the liquid chamber A from the container body increases the volume of the head space in the container body accordingly and would depressurize the head space. However, while the nozzle head portion 22 rises when it is released after it is pushed down, the air hole 24*g* is left open, and the outside air entering through the space between the outer peripheral face of the inner tubular portion 22*a* of the nozzle head portion 22 and the inner peripheral face of the upright wall 20*c* of the base cap portion 20 is drawn immediately into the container body through the air hole 24*g*, releasing the head space in the container body immediately from the depressurized state.

When the nozzle head portion 22 is pushed down again in a state in which the liquid chamber A is filled with the foamable liquid and the nozzle head portion 22 is returned to its highest position, the air piston 28, the liquid piston 26, and the first to fifth check valves function in the same way as in the push-down operation described earlier. As a result, the liquid chamber A and the air chamber B are pressurized as the liquid piston 26 and the air piston 28 are lowered, sending the foamable liquid from the liquid chamber A to the mixing chamber C through the space between the latch portion 40*a* of the rod-shaped valve body 40 and the liquid chamber valve seat portion 26*a*, and the space between the latch portion 40*a* of the rod-shaped valve body 40 and the flexible valve seat part 36*b*, and pumping air from the air chamber B to the mixing chamber C through the air passage D. The liquid and the air are mixed to a foam in the mixing chamber C.

When the nozzle head portion 22 is released again, the air piston 28, the liquid piston 26, and the first to fifth check valves function in the same way as described earlier. As a result, the foamable liquid in the container body is drawn again into the liquid chamber A through the tubular body 12, and air is drawn into the air chamber B from the outside of the container through the air intake 28*g*. The container is thus ready for producing foam. Then, by pushing down and releasing the nozzle head portion 22 repeatedly, a desired amount of foam can be discharged from the foam discharge opening 22*c* provided at the tip of the nozzle head portion 22.

Foam produced in the mixing chamber C as described above then passes through the porous sheet 38*a* with a larger mesh and the porous sheet 38*b* with a smaller mesh, in that order, in the foam passage E in the nozzle head portion 22, to become smoother even foam, and is discharged finally from the foam discharge opening 22*c* disposed at the tip of the nozzle head portion 22.

In the dispensing pump body 10 of this embodiment, when the nozzle head portion 22 is held in its highest position, the flexible valve seat part 36*b* comes into contact with the latch portion 40*a* of the rod-shaped valve body 40, closing the outlet of the air passage D. Even if the liquid or foam remaining in the mixing chamber C flows down after foam is discharged, nothing will flow backward into the air passage D. Immediately after the nozzle head rises when it is released after it is pushed down, the liquid or foam remaining in the mixing chamber C is first drawn into the liquid chamber A, so that little foam or liquid flows backward into the air passage D. The dispensing pump body 10 in this embodiment is free from operation problems caused by the liquid flowing back to the air passage D and becoming stuck, thus blocking or narrowing the air passage D, and can always supply a stable amount of air, so that foam of good quality can always be discharged.

Although a foam-dispensing pump container according to an embodiment of the present invention has been described, the present invention is not confined to the specific structure indicated in the embodiment. The pumping mechanism is not confined to the mechanism indicated in the embodiment and can be implemented by another conventionally known pumping mechanism within the scope of foam-dispensing pump containers for producing foam by mixing a foamable liquid and air in the mixing chamber. The design of the other components can also be modified appropriately in accordance with the specific use.

DESCRIPTION OF THE REFERENCE SYMBOLS

10: dispensing pump body
12: tubular body
20: base cap portion
22: nozzle head portion
24: double-walled cylinder (24A: liquid cylinder; 24B: air cylinder)
26: liquid piston
28: air piston
30: ball valve
32: tubular latch body
34: elastic valve body
36: flexible valve seat portion
38: porous material holder
40: rod-shaped valve

What is claimed is:

1. A foam-dispensing pump container including a container body and a dispensing pump body attached to an opening of the container body, the foam-dispensing pump container producing foam by mixing air and a foamable liquid contained in the container body in an air-liquid mixing unit and discharging the foam from a foam discharge opening disposed in a nozzle head portion provided in the upper part of the dispensing pump body when the nozzle head portion is moved up and down;

the dispensing pump body comprising:

a tubular liquid cylinder which can be connected to the inside of the container;

a liquid suction valve body which can come into contact with a valve seat portion provided on the inner side of the liquid cylinder and which can consequently open and close the connecting portion between the liquid cylinder and the container;

a tubular liquid piston which can move upward and downward in sliding contact with the inner wall face of the liquid cylinder, makes a liquid chamber at the gap with respect to the liquid cylinder, draws the foamable liquid into the liquid chamber from the container body when moved upward, and pumps the foamable liquid from the liquid chamber through an opening end provided in the upper part to the air-liquid mixing unit thereabove when moved downward;

a closed bottom tubular air cylinder which has a greater diameter than the liquid cylinder and surrounds the outside of the liquid cylinder almost concentrically;

a tubular air piston which can move upward and downward in sliding contact with the inner wall face of the air cylinder, makes an air chamber at the gap with respect to the air cylinder, draws air through an air intake provided to be able to be connected to an upper external space, from the space into the air chamber when moved upward, and pumps air upward through an air vent provided above from the air chamber when moved downward;

an air intake valve body which can open and close the air intake;

an air vent valve body which can open and close the air vent;

an air passage which is connected to the air chamber through the air vent and guides air to the air-liquid mixing unit thereabove;

the air-liquid mixing unit, which is tubular and is connected through an upper opening end of the liquid piston to the inside of the liquid chamber and through the air passage to the inside of the air chamber and produces foam by mixing the foamable liquid drawn from the liquid chamber and air drawn from the air chamber;

a spring which is inserted between the liquid cylinder and the liquid piston to exert force in such a direction that the gap between the liquid cylinder and the liquid piston is expanded;

a rod-shaped valve body which is disposed in a space formed by the liquid cylinder and the liquid piston, has an upper end penetrating the upper opening end of the liquid piston, has an almost funnel-shaped latch portion at its penetrating upper end, the outer diameter of the latch portion being greater than the diameter of the upper opening end of the liquid piston, the outer peripheral face of the latch portion being able to come into contact with the inner peripheral face of the upper opening end of the liquid piston, and the valve body thereby being able to open and close the connecting portion between the liquid piston and the air-liquid mixing unit;

a flexible valve seat portion which includes a plate-like member having flexibility at least in a downward direction, the member being provided below the air-liquid mixing unit, protruding circumferentially inwardly in the air-liquid mixing unit, being able to come into contact with the outer peripheral face of the latch portion of the rod-shaped valve body, and thereby being able to open and close the connecting portions between the air-liquid mixing unit and the liquid chamber and between the air-liquid mixing unit and the air passage, projecting closer to the outer peripheral face of the latch portion of the rod-shaped valve body than the upper opening end of the liquid portion, the valve seat portion being able to come into contact with the outer peripheral face of the latch portion of the rod-shaped valve body whereas the outer peripheral face of the latch portion of the rod-shaped valve body is not in contact with the inner peripheral face of the upper opening end of the liquid piston; and a nozzle head which is connected to the air-liquid mixing unit, can move up and down together with the liquid piston and the air piston, and discharges foam produced in the air-liquid mixing unit from a foam discharge opening provided in the opposite end when moved downward.

2. The foam-dispensing pump container according to claim 1, the valve seat portion provided in the liquid cylinder and the liquid suction valve body constitute a first valve, the two not coming into contact with each other to open the connecting portion between the liquid cylinder and the container body when the nozzle head moves up, and coming into contact with each other to close the connecting portion between the liquid cylinder and the container body when the nozzle head moves down;

the air intake provided in the air piston and the air intake valve body constitute a second valve, the air intake valve body not coming into contact with the air intake to open the connecting portion between the air chamber and the external space above the air piston when the nozzle head moves up, and the two coming into contact with each other to close the connecting portion between the air chamber and the external space above the air piston when the nozzle head moves down;

the air vent provided in the liquid piston and the air vent valve body constitute a third valve, the air vent valve body coming into contact with the air vent to close the connecting portion between the air chamber and the air passage when the nozzle head moves up, and the two not coming into contact with each other to open the connecting portion between the air chamber and the air passage when the nozzle head portion moves down;

the inner peripheral face of the upper opening end of the liquid piston and the outer peripheral face of the latch portion of the rod-shaped valve body constitute a fourth valve, the two coming into contact with each other to close the connecting portion between the liquid chamber and the air-liquid mixing unit when the nozzle head moves up, and the two not coming into contact with each other to open the connecting portion between the liquid chamber and the air-liquid mixing unit when the nozzle head portion moves down;

the flexible valve seat portion provided in the air-liquid mixing unit and the outer peripheral face of the latch portion of the rod-shaped valve body constitute a fifth valve, the two coming into contact with each other to close the connecting portions between the liquid chamber and the air-liquid mixing unit and between the air passage and the air-liquid mixing unit when the nozzle head moves up, and the two not coming into contact with each other to open the connecting portions between the liquid chamber and the air-liquid mixing unit and between the air passage and the air-liquid mixing unit when the nozzle head moves down; and when the nozzle head moves up from the bottom dead center, the flexible valve seat portion in the fifth valve comes into contact with the outer peripheral face of the latch portion of the rod-shaped valve body before the upper opening end of the liquid piston portion in the fourth valve comes into contact with the outer peripheral face of the latch portion of the rod-shaped valve body, thereby closing the fifth valve and opening the fourth valve temporarily.

3. The foam-dispensing pump container according to claim 1, the flexible valve seat portion has a bent edge portion.

* * * * *